US007721475B2

(12) United States Patent
Chiang et al.

(10) Patent No.: US 7,721,475 B2
(45) Date of Patent: May 25, 2010

(54) SIMULATED NEON ILLUMINATING SIGN

(76) Inventors: John Chiang, 1965 Plaza Rd., Oceanside, CA (US) 92065; Ken-Sheng Chiang, 1965 Plaza Rd., Oceanside, CA (US) 92065

( * ) Notice: Subject to any disclaimer, the term of this patent is extended or adjusted under 35 U.S.C. 154(b) by 55 days.

(21) Appl. No.: 11/786,966

(22) Filed: Apr. 13, 2007

(65) Prior Publication Data

US 2008/0060236 A1 Mar. 13, 2008

Related U.S. Application Data

(60) Provisional application No. 60/843,459, filed on Sep. 8, 2006.

(51) Int. Cl.
*G09F 13/00* (2006.01)

(52) U.S. Cl. ..... 40/541; 40/564; 40/580

(58) Field of Classification Search ..... 40/580, 40/552, 541, 52, 564
See application file for complete search history.

(56) References Cited

U.S. PATENT DOCUMENTS 1,904,850 A * 4/1933 Boyce et al. ..... 40/552
2,382,806 A * 8/1945 Motson ..... 430/292
4,016,450 A * 4/1977 Balekjian ..... 315/149
4,891,896 A * 1/1990 Boren ..... 40/541
4,967,317 A * 10/1990 Plumly ..... 362/613
5,009,019 A * 4/1991 Erlendsson et al. ..... 40/541
7,162,821 B2 * 1/2007 Venkataraman et al. ..... 40/541

* cited by examiner

*Primary Examiner*—Cassandra Davis
(74) *Attorney, Agent, or Firm*—Raymond Y. Chan; David and Raymond Patent Firm

(57) ABSTRACT

A sign panel made of light transmitting material, has a front displaying side and a rear side, the sign panel has a background portion that is preferably a flat surface and a protruding portion that forms a sign character, wherein a lighting blocking layer attached to said background portion of the sign panel, and a highlight coating coated on said protruding portion of the rear side of the sign panel. Light can go through the protruding portion with a highlight coating. The sign panel can use without a complicated neon light tubes, and the sign panel contains no mercury versus argon based neon tubes. This is a huge win from the environmental side as there is no use for mercury inside LED signs.

7 Claims, 5 Drawing Sheets

SIMULATED NEON ILLUMINATING SIGN

CROSS REFERENCE OF RELATED APPLICATION

This is a non-provisional application of a provision application having an application No. 60/843,459 and a filing date of Sep. 8, 2006.

BACKGROUND OF THE PRESENT INVENTION

1. Field of Invention

The present invention relates to a sign, and more particularly to an illumination sign which is capable of simulating a typical neon illuminating sign without involving the difficulties associated therewith.

2. Description of Related Arts

A conventional neon illuminating sign usually uses argon based tubes as a light source. The argon based tubes always has mercury in it. The mercury may be harmful to the environment as well as the user when leakage occurs. As a result, many people may switch to LED illuminating sign instead of the conventional neon illuminating sign. What is we basically have as a light source is a diode with specified crystals attached to produce the intense illumination without employment anything that may be harmful to the environment like mercury.

There are many kinds of phosphor that exist in the market today but the ultraviolet ray phosphor is the one most suitable for this application. These phosphors only fully activate under the condition that they're hit with ultraviolet rays. That is exactly what the selected LEDs emits and hence the application. This has proved to give off the best effect to achieve the unique look of phosphorus coated glass; neon.

An important technology employed on these signs that is easily overlooked. Normally after you vacuum form the plastic, the edges and the places surrounding the raised form the plastic, the edges and the places surrounding the raised from is rugged and jagged. This of course is not appealing and the paint becomes extremely uneven and worn. To solve this, we employ a smooth laser cut overlay panel that is cut out via the design in the front to lay on top to transform the sign into modern art. This implies that we no longer need to do an accurate screen print of the design before semi-forming. We would just proceed with the colors roughly and cover the rest up via the laser cut overlay panel.

Above of all, the purpose of these signs is to be alternatives to neon signs. They provide many advantages such as freight cost reduction (less packing, weighs less, and don't break), lower power consumption, and the biggest feat of all, it contains no mercury versus argon based neon tubes. This is a huge advantage from the environmental point of view.

In other words, conventional neon illuminating signs contain harmful substance which causes potential danger to the users and the environment. Moreover, the manufacturing process of the conventional neon illuminating signs is complicated, and expensive to operate. At the time being, however, there is little alternative when one wishes to manufacture an illuminating sign which has substantially the same performance as achieved by conventional illuminating neon signs.

SUMMARY OF THE PRESENT INVENTION

A main object of the present invention is to provide a simulated neon illuminating sign. Such a simulated neon illuminating sign is simple structure, cheap cost, and without employment anything that may be harmful to the environment such as mercury.

Another object of the present invention is to provide an illumination sign which is capable of producing an illumination effect as that of conventional neon illuminating signs, yet without involving the utilization of any harmful gases or substances to producing illumination.

Another object of the present invention is to provide an illumination sign which easy to manufacture and simple in structure, wherein the illumination sign could be utilized in a wide variety of circumstances for providing high quality illumination of predetermined sign characters. Moreover, the present invention is capable of utilizing a wide variety of light sources for providing illumination of sign characters.

Accordingly, in order to accomplish the above objects, the present invention provides an illumination sign, comprising:

a light-admissible sign panel which has a rear side and a front displaying side and defines a flat background portion and a plurality of protruding portions protruded from the sign panel to form a corresponding number of character signs at the front displaying side of the sign panel, wherein the sign panel has a predetermined light admissibility for allowing light to pass through the sign panel;

a light blocking layer, which is made of light-inadmissible material, provided on the background portion of the sign panel for blocking the light passing through the sign panel at the background portion thereof; and a highlighting element provided at the rear side of the sign panel and arranged in such a manner that when the light passes through the protruding portions of the sign panel, the highlighting element creates a neon illuminating effect at the protruding portions of the sign panel, such that the character signs are illuminated at the front displaying side of the sign panel through the protruding portions for simulating a three dimensional neon illumination effect of the sign panel.

These and other objectives, features, and advantages of the present invention will become apparent from the following detailed description, the accompanying drawings, and the appended claims.

DETAILED DESCRIPTION OF THE PREFERRED EMBODIMENT

Figure 1:
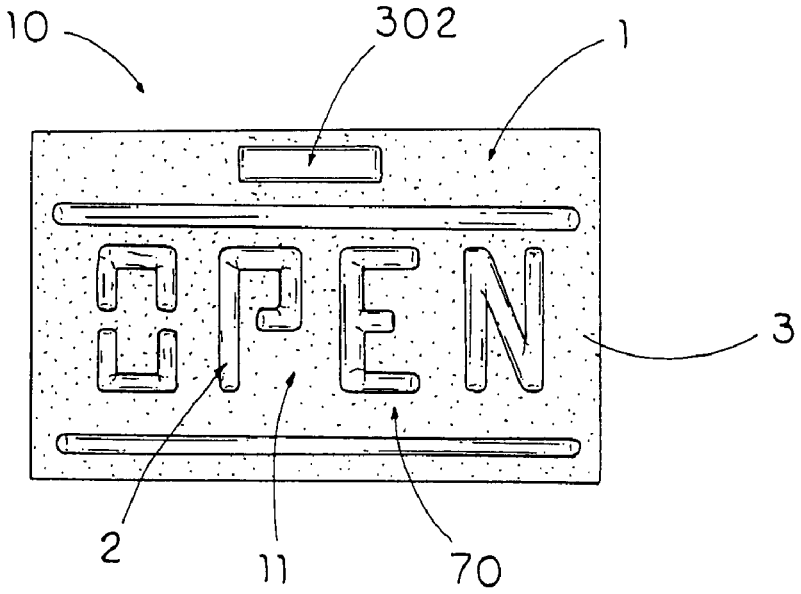
FIG. 1 is a front view showing the illumination sign according to a preferred embodiment of the present invention.

Throughout the following detailed description, the same reference numerals refer to the same elements in all figures.

Figure 2:
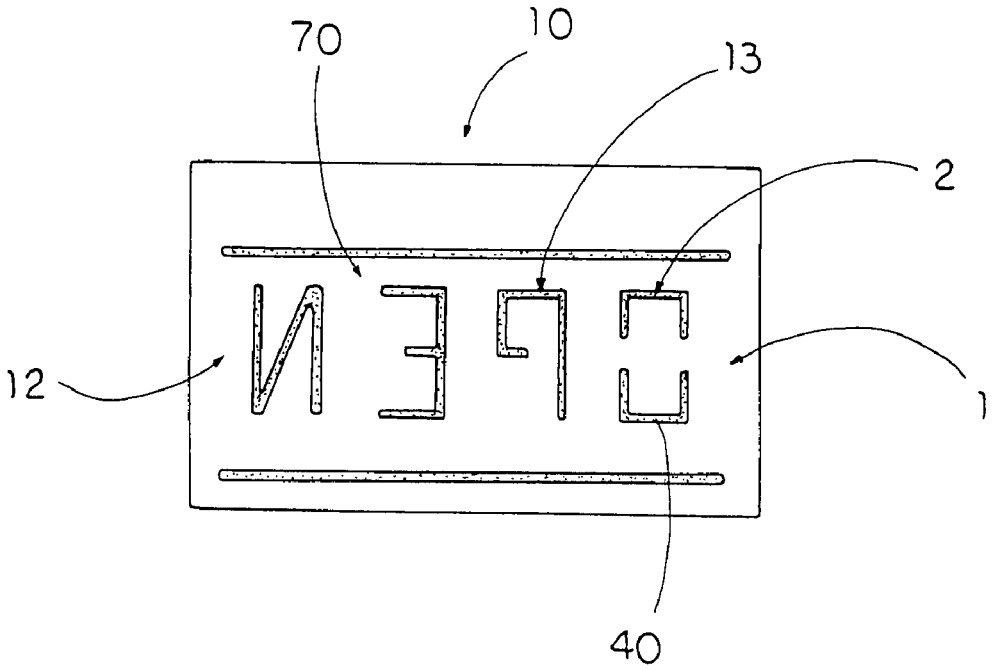
FIG. 2 is a rear view of the illumination sign according to the above preferred embodiment of the present invention.

Referring to FIG. 1 and FIG. 2, the sign panel, made of light transmitting material, has a front displaying side and a rear side, the sign panel 10 has a background portion 1 that is preferably a flat surface and a protruding portion 2 that forms a sign character, wherein a lighting blocking layer 3 attached to said background portion 2 of the sign panel 10, and a highlight coating 5 coated on said protruding portion 2 of the rear side of the sign panel 10.

Figure 5:
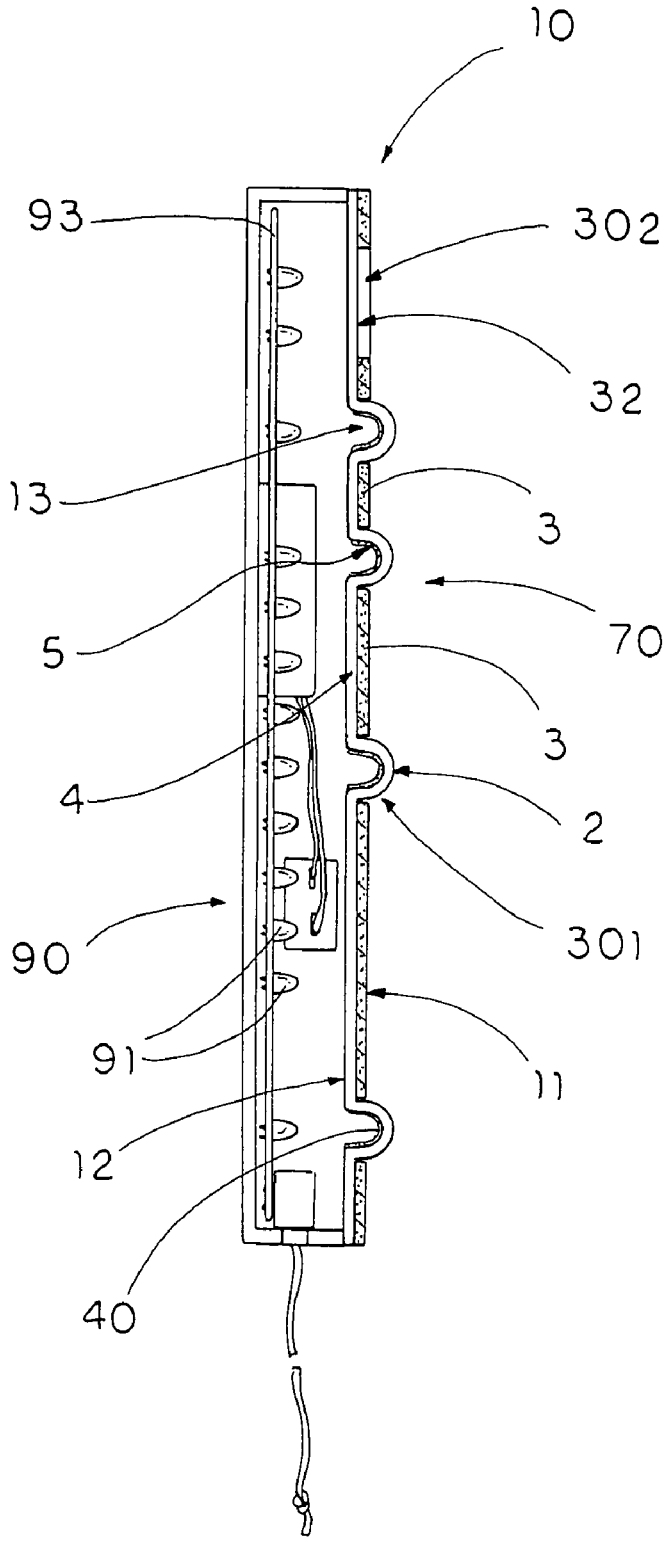
FIG. 5 is a sectional side view of the illumination sign according to the above preferred embodiment of the present invention.
Figure 6:
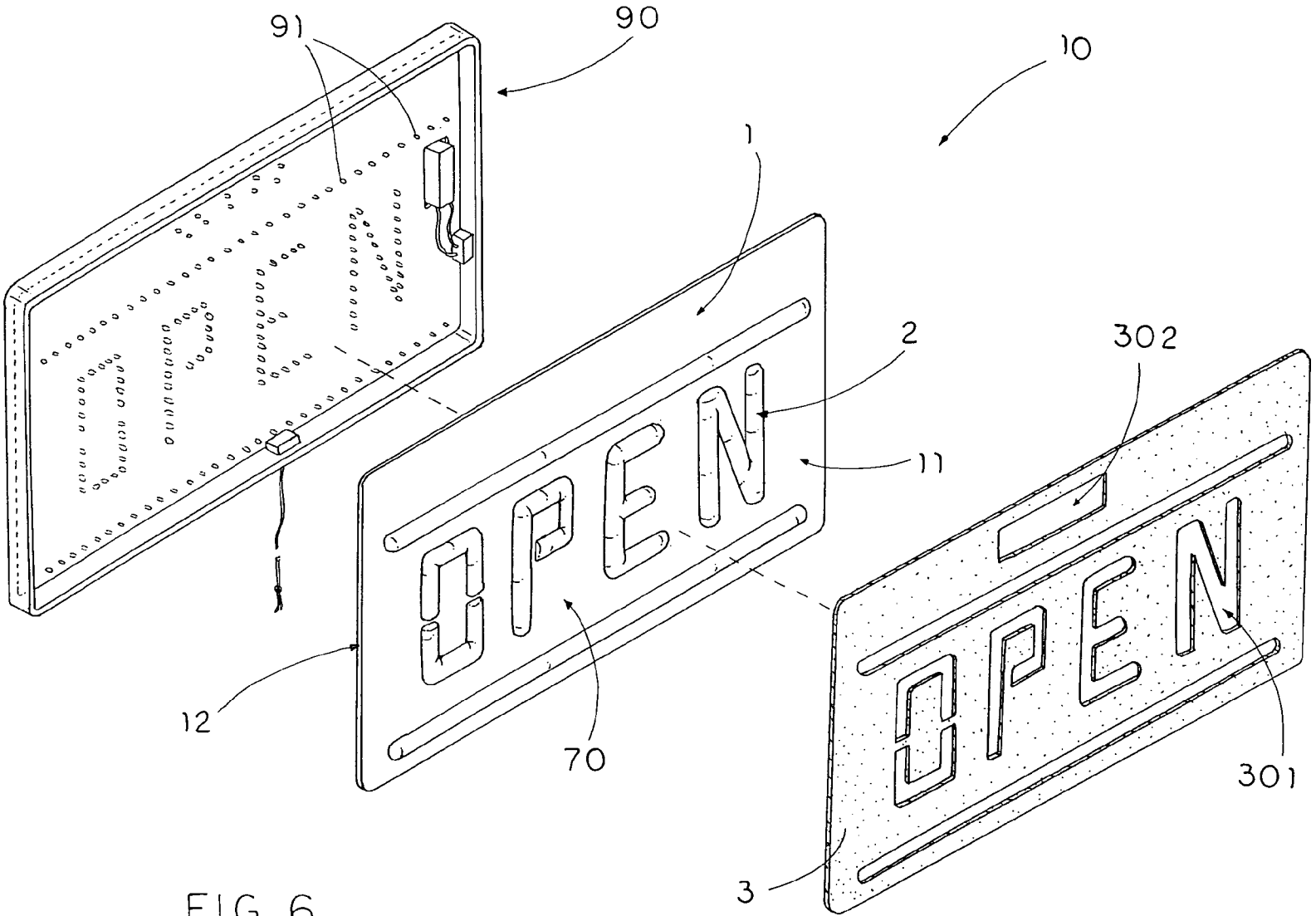
FIG. 6 is an exploded perspective view of the illumination sign according to the above preferred embodiment of the present invention.
Figure 7:
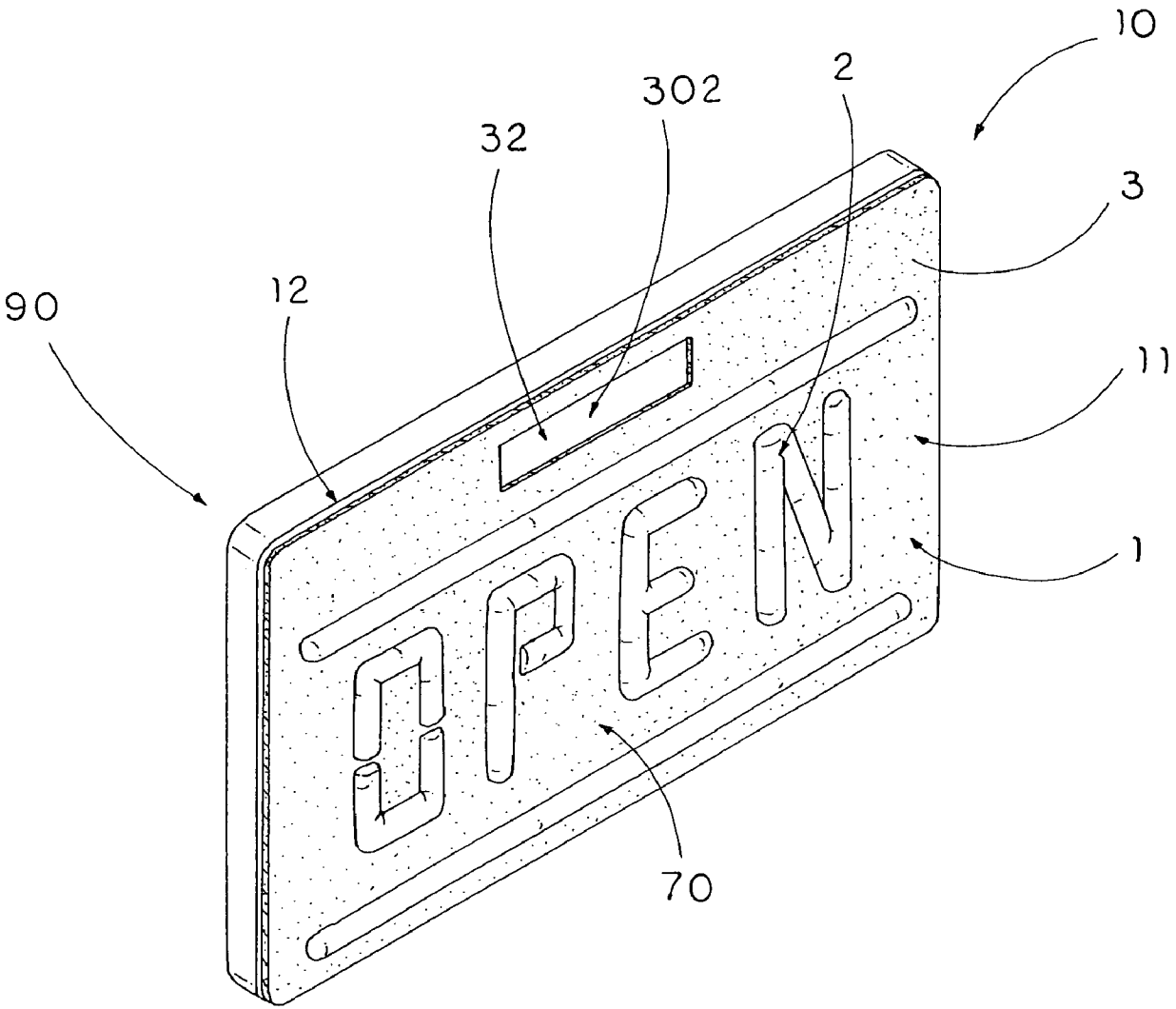
FIG. 7 is a schematic view of the illumination sign according to the above preferred embodiment of the present invention.

Further more, as shown of FIG. 1 and FIG. 5, the background portion 1 of the front displaying side of the sign panel 10 is coated with a black color blocking layer 3 so that the light can not go though the background portion 1, and the protruding portion 2 of the front displaying side of the sign panel 10 forms the sign character.

As shown of FIG. 2 and FIG. 5, the background portion 1 of the rear side of the sign panel 10 is coated with a red color layer 4 so that the light can not go though the background portion 1, and the protruding portion 2 of the rear side of the sign panel 10 is protruding to the front displaying side. A highlight coating 5 with different colors can be coated on the protruding portion 2 of the rear side of the sign panel 10 to create a neon illuminating effect when the light projects thereto or from the rear side of the sign panel 10.

Figure 3:
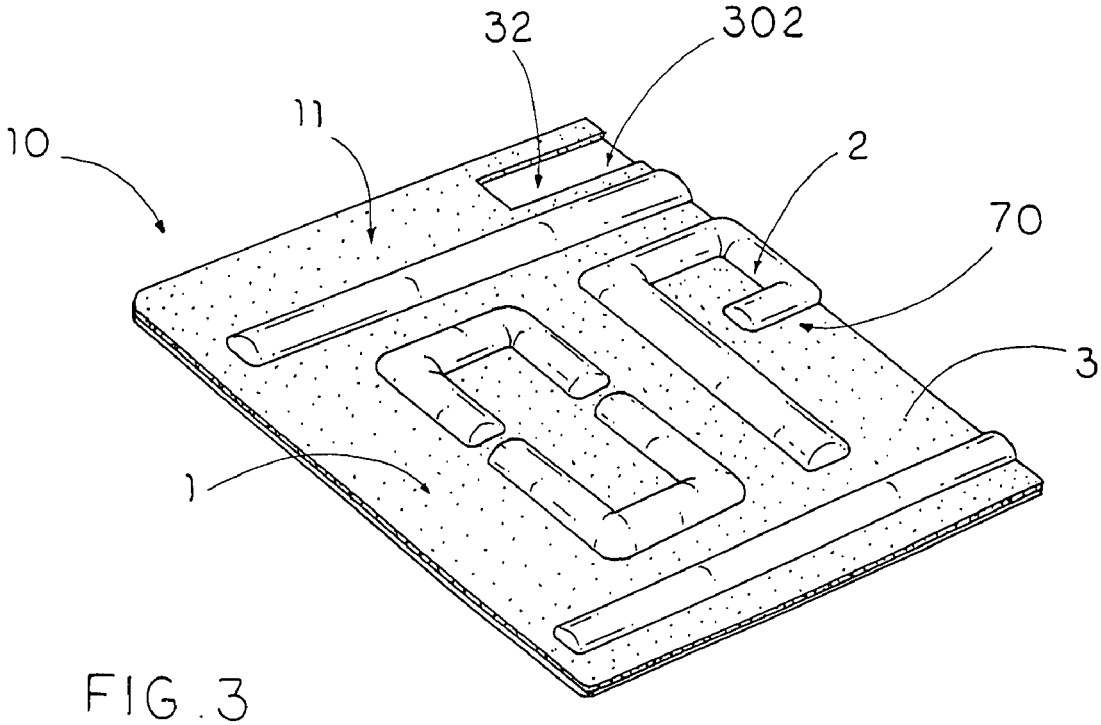
FIG. 3 is a front perspective view of the illumination sign according to the above preferred embodiment of the present invention.
Figure 4:
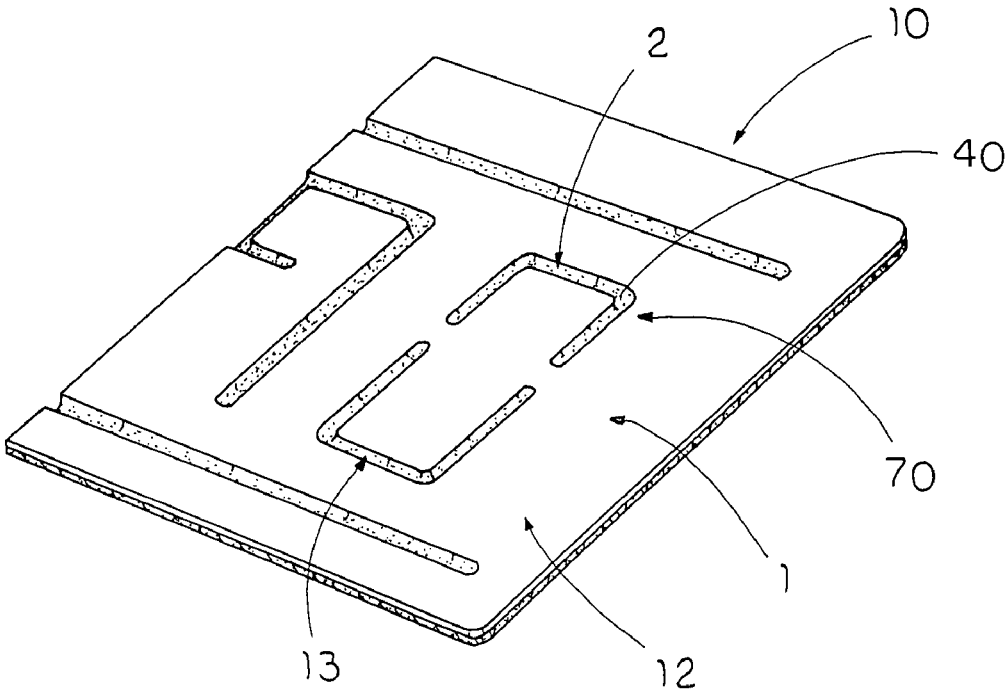
FIG. 4 is a rear perspective view of the illumination sign according to the above preferred embodiment of the present invention.

As shown in FIG. 3 and FIG. 4, the sign panel 10 made of light transmitting material (either transparent or translucent material) for light passing from one side to another opposed side. The protruding portion 2 of the sign panel 10 has curved cross section by plastic injection. And the cross section of the protruding portion 2 presents semi-circle. Light can go through the protruding portion 2 and make the protruding portion 2 looks like a sign character.

As shown of FIG. 5, the protruding portion 2 of the sign panel 10 is a vacuum formed panel. Smooth, even, and strong adhesion of phosphor coating on the vacuum formed letter is made possible with epoxy as binder. Normally after you vacuum form the plastic, the edges and the places surrounding the raised form the plastic, the edges and the places surrounding the raised from is rugged and jagged. This of course is not appealing and the paint becomes extremely uneven and worn. To solve this, we employ a smooth laser cut overlay panel that is cut out via the design in the front to lay on top to transform the sign into modern art. This implies that we no longer need to do an accurate screen print of the design before semi-forming. We would just proceed with the colors roughly and cover the rest up via the laser cut-overlay panel.

The light housing houses a light source therein to electrically connect to a power source. The light source can be a plurality of LEDs, or conventional fluorescent light tube to generate the light towards the rear side of the sign panel 10. No neon light is required. For LED configuration, a circuit board is required to electrically connect and support the LEDs in the light housing. In addition, the LEDs are supported and aligned to the sign character.

The simulated neon illuminating sign, comprising a sign panel 10 with sign character and a light housing which providing light for said sign panel 10, wherein said sign panel 10 is a board made of light transmitting material, having a background portion and a protruding portion, said light housing is a light source therein to electrically connect to a power source, the light source generate the light towards the rear side of said sign panel 10.

The sign panel 10 made of light transmitting material, has a front displaying side and a rear side, the sign panel 10 has a background portion that is preferably a flat surface and a protruding portion that forms a sign character, wherein a lighting blocking layer attached to said background portion of the sign panel 10, and a highlight coating coated on the protruding portion of the rear side of the sign panel 10.

The sign panel 10 made of light transmitting material (either transparent or translucent material) for light passing from one side to another opposed side. The background portion of the sign panel 10 is a flat surface with a blocking layer. The blocking layer attached to either or both sides of the background portion of the sign panel 10. A light blocking coating can be further coated at the rear side of the sign panel 10 within the background portion thereof. All the blocking layer and coating used to block the light passing there through so as to define the sign character at the protruding sign portion. The protruding portion of the sign panel 10 has curved cross section by plastic injection. The cross section of the protruding portion of the sign panel 10 presents semi-circle (or other shape if any). A highlight coating with different colors can be coated on the protruding portion of the rear side of the sign panel 10 to create a neon illuminating effect when the light projects thereto or from the rear side of the sign panel 10.

The light housing is a light source therein to electrically connect to a power source, the light source generate the light towards the rear side of said sign panel 10.

To describe the prevent invention in a more specific manner, referring to FIG. 1 to FIG. 7 of the drawings, an illumination sign according to a preferred embodiment of the present invention is illustrated, in which the illumination sign comprises a light-admissible sign panel 10, a light blocking layer 3, and a highlighting element 40.

The light-admissible sign panel 10 has a background portion 1, and a plurality of protruding portions 2 protruded from the sign panel 10 to form a corresponding number of character signs 70 at a front displaying side 11 of the sign panel 10, wherein the sign panel 10 has a predetermined light admissibility for allowing visible light to pass therethrough.

The light blocking layer 3, which is made of light-inadmissible material, is overlappedly formed on the background portion 1 of the sign panel 10, wherein when light is illuminating from a rear side 12 of the sign panel 10, the light is allowed to pass through the protruding portions 2 of the sign panel 10, but simultaneously blocked by the light blocking layer 3.

The highlighting element 40 is provided at the rear side 12 of the sign panel 10 and arranged in such a manner that when the light passes through the protruding portions 2 of the sign panel 10, the highlighting element 40 creates a neon illuminating effect at the protruding portions 2 of the sign panel 10, such that the character signs 70 are illuminated at the front displaying side 11 of the sign panel 10 through the protruding portions 2 for simulating a three dimensional neon illumination effect of the sign panel 10. The highlighting element 40 is preferably ultraviolet ray phosphor coating coated on the rear side 12 of the sign panel 10.

According to the preferred embodiment of the present invention, the sign panel 10 is shaped and crafted to have a predetermined shape as a shape of the illumination sign which is to be displayed at a predetermined position. The sign panel 10 is made of light-admissible material so that when light passes through the sign panel 10, the sign panel 10 will be illuminated from the front displaying side 11 thereof.

The protruding portions 2 are formed on the front displaying side 11 of the sign panel 10 for forming a plurality of character signs 70 thereon. Accordingly, the sign panel 10 further has a corresponding number of channels 13 indently formed at a rear side 12 of the sign panel 10 for forming the protruding portions 2 at the front displaying side 11. It is worth mentioning that the shape of each of the channels 13 constitutes the contour of the corresponding character sign 70 so that the character signs 70 can be easily produced during the manufacturing process by pressing the channel 13 on the sign panel 10 or by making the sign panel 10 by conventional molding techniques.

The light blocking layer 3, which is overlappedly mounted on the front displaying side 11 of the sign panel 10 at the background portion 1 thereof, has a plurality of through shaping slots 301 shaped corresponding to the protruding portions 2 of the sign panel 10, wherein when the light blocking layer 3 is overlapped on the front displaying side 11 of the sign panel 10, the protruding portions 2 of the sign panel 10 are projected through the shaping slots 301, such that the light blocking layer 3 is only overlapped on the background portion 1 of the sign panel 10 for blocking the light from passing through the background portion 1 of the sign panel 10.

It is worth mentioning that the light blocking layer 3 comprises a light inadmissible coating for blocking light from passing through the background portion 1 of the sign panel 10. According to the preferred embodiment of the present invention, the light blocking layer 3 comprises a black-colored light inadmissible coating for blocking light passing therethrough, and contrasting with the protruding portions 2 of the sign panel 10 so as to optimally highlight the character signs 70 at the front displaying side 11 of the sign panel 10.

Moreover, the light blocking layer 3 further has at least a through decorative slot 302 formed thereon and arranged when the light blocking layer 3 is overlappedly mounted on the front displaying side 11 of the sign panel 10 at the background portion 1 thereof, the sign panel 10 further forms a decorative portion 32 within the background portion 1 thereof through the decorative slot 302 such that not only the character signs 70 but also the decorative portion 32 are illuminated at the front displaying side 11 of the sign panel 10 for simulating the neon illumination effect of the sign panel 10. The decorative portion 32 therefore forms a decorative pattern on the sign panel 10.

In order to strengthen the illumination effect of the sign characters 70, each of the protruding portions 2 of the sign panel 10 has a curved cross section integrally protruding from the flat background portion 1 of the sign panel 10 at the front displaying side 11 thereof to create the sign character 70 in a three dimension manner.

The operation of the present invention is as follows: the illumination sign is erected or supporting in front of a light source, such as a conventional light box 90. When light passes through the illumination sign, only those portion of light which impinges on the protruding portion 2 of the sign panel 10 and the decorative portion 32 is allowed to penetrate the entire illumination sign so that the character signs 70 and the decorative patterns are lit up by the light source to produce a three-dimensional illumination at the illumination sign. It is particularly important to note that the present invention is capable of producing illumination of character signs 70 and decorative patterns having three-dimensional illumination performance without utilizing any harmful substances, such as argon gas or mercury.

Hence, it is important to mention that the present invention may well be incorporated with a light source, which may be embodied as a light box 90 comprising a plurality of LEDs 91 emitting illumination of a predetermined color, mounted at the rear side 12 of the sign panel 10 so as to produce the neon illumination effect at the character signs 70 and the decorative patterns of the illumination sign of the present invention.

In other words, the illuminating sign further comprises a backlight arrangement for providing illumination to the sign panel 10, wherein the backlight arrangement comprises a light box 90 mounted at the rear side 12 of the sign panel 10 and a plurality of illuminators embodying as LEDs 91 which are spacedly supported within the light box 90 and are electrically connected to a circuit control 93 for generating the light towards the sign panel 10. Each of the LEDs generates light with a wave length matching an ultraviolet wave length of the ultraviolet ray phosphor coating (i.e. highlighting element 40) on the sign panel 10.

One common concern regarding conventional neon signs is the use of harmful substances such as mercury or argon. The present invention completely gets rid of this requirement in that the light source of the illumination sign can be LEDs 90, which are diode with specific crystals.

Moreover, it is important to state that the sign panel 10 is arranged to be cut with laser so that it will have precise shape and smooth edges.

The practical purpose of the present invention is to provide an alternative to conventional neon signs in terms of performance. Yet the present invention is made of light materials and utilizes diodes as a light source. As a result, the illumination sign of the present invention enjoys low transportation cost and energy consumption as additional advantages.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An illumination sign, comprising:

a light-admissible sign panel which has a rear side and a front displaying side and defines a flat background portion and a plurality of protruding portions protruded from said sign panel to form a corresponding number of character signs at said front displaying side of said sign panel, wherein said sign panel has a predetermined light admissibility for allowing light to pass through said sign panel;

a light blocking layer, which is made of light-inadmissible material, provided on said background portion of said sign panel for blocking said light passing through said sign panel at said background portion thereof; and a highlighting element provided at said rear side of said sign panel and arranged in such a manner that when said light passes through said protruding portions of said sign panel, said highlighting element creates a neon illuminating effect at said protruding portions of said sign panel, such that said character signs are illuminated at said front displaying side of said sign panel through said protruding portions for simulating a three dimensional neon illumination effect of said sign panel, wherein said light blocking layer further has at least a through decorative slot formed thereon and arranged when said light blocking layer is overlappedly mounted on said front displaying side of said sign panel at said background portion thereof, said sign panel further forms a decorative portion on said sign panel within said background portion thereof through said decorative slot such that not only said character signs but also said decorative portion are illuminated at said front displaying side of said sign panel for simulating said neon illumination effect of said sign panel, wherein said highlighting element is ultraviolet ray phosphor coating coated on said rear side of said sign panel.

2. The illuminating sign, as recited in claim 1, further comprising a backlight arrangement for providing illumination to said sign panel, wherein said backlight arrangement comprises a light box mounted at said rear side of said sign panel and a plurality of LEDs which are spacedly supported within said light box and are electrically connected to a circuit control for generating said light towards said sign panel.

3. The illuminating sign, as recited in claim 2, wherein each of said LEDs generates said light with a wave length matching an ultraviolet wave length of said ultraviolet ray phosphor coating on said sign panel.

4. An illumination sign, comprising:

a light-admissible sign panel which has a rear side and a front displaying side and defines a flat background portion and a plurality of protruding portions protruded from said sign panel to form a corresponding number of character signs at said front displaying side of said sign panel, wherein said sign panel has a predetermined light admissibility for allowing light to pass through said sign panel;

a light blocking layer, which is made of light-inadmissible material, provided on said background portion of said sign panel for blocking said light passing through said sign panel at said background portion thereof; and a highlighting element provided at said rear side of said sign panel and arranged in such a manner that when said light passes through said protruding portions of said sign panel, said highlighting element creates a neon illuminating effect at said protruding portions of said sign panel, such that said character signs are illuminated at said front displaying side of said sign panel through said protruding portions for simulating a three dimensional neon illumination effect of said sign panel, wherein said light blocking layer further has at least a through decorative slot formed thereon and arranged when said light blocking layer is overlappedly mounted on said front displaying side of said sign panel at said background portion thereof, said sign panel further forms a decorative portion on said sign panel within said background portion thereof through said decorative slot such that not only said character signs but also said decorative portion are illuminated at said front displaying side of said sign panel for simulating said neon illumination effect of said sign panel, wherein said sign panel, having a uniform thickness, further has a plurality of channels indently formed at said rear side of said sign panel to correspondingly form said protruding portions at said front displaying side, wherein a shape of each of said channels constitutes a contour of said corresponding character sign, wherein said highlighting element is ultraviolet ray phosphor coating coated on said rear side of said sign panel.

5. The illuminating sign, as recited in claim 4, further comprising a backlight arrangement for providing illumination to said sign panel, wherein said backlight arrangement comprises a light box mounted at said rear side of said sign panel and a plurality of LEDs which are spacedly supported within said light box and are electrically connected to a circuit control for generating said light towards said sign panel.

6. The illuminating sign, as recited in claim 5, wherein each of said LEDs generates said light with a wave length matching an ultraviolet wave length of said ultraviolet ray phosphor coating on said sign panel.

7. The illuminating sign, as recited in claim 4, wherein each of said protruding portions of the sign panel has a curved cross section integrally protruding from said flat background portion of said sign panel at said front displaying side thereof to create said sign character in a three dimension manner.

* * * * *